United States Patent [19]

Minami et al.

[11] Patent Number: 4,715,909

[45] Date of Patent: Dec. 29, 1987

[54] NICKEL-CHROMIUM ALLOY IN STRESS CORROSION CRACKING RESISTANCE

[75] Inventors: Takao Minami, Amagasakishi; Hiroo Nagano, Kobeshi; Kazuo Yamanaka, Minooshi; Yasutaka Okada, Narashi; Hiroshi Susukida, Takasago; Kichiro Onimura, Takasago; Toshio Yonezawa, Takasago; Nobuya Sasaguri, Takasago, all of Japan

[73] Assignees: Mitsubishi Jukogyo Kabushiki Kaisha, Tokyo; Sumitomo Metal Industries, Ltd., Osaka, both of Japan

[21] Appl. No.: 878,398

[22] Filed: Jun. 19, 1986

Related U.S. Application Data

[63] Continuation of Ser. No. 550,023, Nov. 8, 1983, abandoned.

[30] Foreign Application Priority Data

Jun. 13, 1983 [JP] Japan ..... 58-104094
Jun. 13, 1983 [JP] Japan ..... 58-104095

[51] Int. Cl.[4] ..... C22C 19/05
[52] U.S. Cl. ..... 148/410; 148/419; 148/428; 148/442

[58] Field of Search ..... 148/410, 428, 13, 162, 148/419, 442

[56] References Cited

U.S. PATENT DOCUMENTS 3,573,901 4/1971 Economy ..... 420/448

*Primary Examiner*—R. Dean
*Attorney, Agent, or Firm*—Toren, McGeady & Associates

[57] ABSTRACT

A nickel-chromium alloy excellent in a stress corrosion cracking resistance which is obtained by carrying out an annealing treatment under specific conditions, said alloy having the following composition:

| in terms of % by weight, | |
|---|---|
| 0.04% or less of C; | 1.0% or less of Si; |
| 1.0% or less of Mn; | 0.030% or less of P; |
| 0.02% or less of S; | 40 to 70% of Ni; |
| 25 to 35% of Cr; | 0.1 to 0.5% of Al; |
| 0.05 to 1.0% of Ti; | |
| 0.5 to 5.0% in all of one or more of Mo, W and V, and | |

the residue comprising substantially Fe. A nickel-chromium alloy further including 0.2 to 5.0% of Nb subject to Ti=0.2 to 1.0% and Nb/C=10 to 125.

2 Claims, 10 Drawing Figures

NICKEL-CHROMIUM ALLOY IN STRESS CORROSION CRACKING RESISTANCE

This is a continuation of application Ser. No. 550,023, filed Nov. 8, 1983, abandoned.

FIELD AND BACKGROUND OF THE INVENTION

The present invention relates to a nickel-chromium alloy excellent in a stress corrosion cracking resistance (hereinafter referred to as the SCC resistance), more specifically, to a nickel-chromium alloy in which the stress corrosion cracking resistance is noticeably improved by depositing an insolubilized carbide in grains thereof and by strengthening a coating on the surface thereof.

Heretofore, or tubes, containers and their fittings used in stress corrosion cracking environments including $Cl^-$ ions in nuclear reactors, chemical plants and the like, many nickel based alloys which are considered to be excellent in the stress corrosion cracking resistance have been used. However, it has been reported that even in the case of a 30% Cr-60% Ni system alloy which has generally been used, the occurrence of the stress corrosion cracking cannot be avoided in certain environments.

Thus, an object of the present invention is to provide an alloy which can overcome such a drawback inherent in the 30% Cr-60% Ni system alloy and which is excellent in a corrosion resistance, especially the stress corrosion cracking resistance so that it may be used for the tubes, the containers and their fittings in the nuclear reactors, the chemical plants and the like in the form of thick-walled plates, round rods or pipes.

The inventors of the present case have paid much attention to the fact that the aforesaid 30% Cr-60% Ni based alloy is finally annealed at a relatively high temperature of 980° to 1150° C. in compliance with a carbon content and is used in a state of including no insolubilized carbide, and they have researched into a relation between a morphology of the carbide in the alloy system and its corrosiveness. As a result, it has been found that an active deposition of the carbide, if in the grains thereof, is rather effective for the improvement in the stress corrosion cracking resistance. Further, in view of the report that in environments of a high-temperature water including $Cl^-$ ions, stress corrosion cracks would occur starting from pitting corrosions, the addition of Mo, W and V, which are known as elements effective for the improvement in the pitting corrosion resistance, has been attempted with the intention of strengthening the coating. In consequence, it has been found that the corrosion resistance, i.e. the stress corrosion cracking resistance of the obtained alloy is noticeably improved in cooperation with the aforementioned deposition effect of the carbide, and the present invention has now been achieved.

SUMMARY OF THE INVENTION

The gist of the present invention is directed to a nickel-chromium alloy excellent in a stress corrosion cracking resistance which is obtained by carrying out an annealing treatment under required conditions, said alloy having the following composition:

| in terms of % by weight, | |
|---|---|
| 0.04% or less of C; | 1.0% or less of Si; |
| 1.0% or less of Mn; | 0.030% or less of P; |
| 0.02% or less of S; | 40 to 70% of Ni; |
| 25 to 35% of Cr; | 0.1 to 0.5% of Al; |
| 0.05 to 1.0% of Ti; | |
| 0.5 to 5.0% in all of one or more of Mo, W and V, and | |

the residue comprising substantially Fe.

The above-mentioned required conditions mean annealing conditions within a range (Y) surrounded by points A, B, C, D and E in FIG. 1 attached hereto or an annealing operation at a temperature of 900° to 975° C. However, in the case of the latter, 0.2 to 5.0% of Nb is further added to the above-mentioned composition on condition that the content of Ti is 0.2 to 1.0% and Nb/C is 10 to 125.

The aforesaid range (Y) is determined by A (C=0%, 910° C.), B (C=0%, 850° C.), C (C=0.02%, 850° C.), D (C=0.04%, 900° C.) and E (C - 0.04%, 1000° C.).

If the operation is made under the annealing condition in the range (Y), the stress corrosion cracking resistance of the Ni-Cr alloy, which is heretofore insufficient, can be remarkably improved. Such an unexpected effect would be considered to be due to a synergistic effect of (i) the requirement that the C content is limited to 0.04% or less and a final annealing is carried out at a relatively low temperature in compliance with the C content, and (ii) the requirement that at least one of Mo, W and V is added as an element for reinforcing the coating.

When the annealing operation is carried out at the aforesaid temperature of 900° to 975° C. according to the present invention, the stress corrosion cracking resistance of the Ni-Cr alloy, which is heretofore insufficient, can also be remarkably improved. Such an effect would be considered to be due to a synergistic effect of (i) the fact that when the C content is limited to 0.04% or less and the final annealing operation is carried out at a relatively low temperature of 900° to 975° C., in the case of the Ni based alloy including 40% or more of Ni, Nb has a greater carbon-fixing effect than Ti, therefore a less amount of Cr carbide will deposit on crystal boundaries, and (ii) the intention that at least one of Mo, W and V is added for the reinforcement of the coating.

BRIEF DESCRIPTION OF THE DRAWINGS

FIG. 1 shows a graph of an annealing temperature with respect to a carbon content in the present invention;

FIGS. 2 to 4 are graphs showing test results of a crystal boundary etching resistance in Examples according to the present invention;

FIG. 5 is a graph likewise showing test results of a stress corrosion cracking resistance;

DETAILED DESCRIPTION OF THE INVENTION

Figure 1:
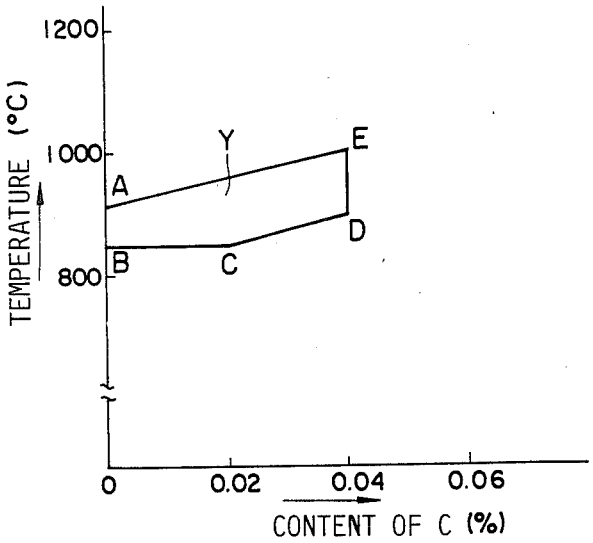
FIGS. 1 to 5 illustrate the case where annealing conditions are in a range (Y)

The reason why a composition of the alloy according to the present invention is defined as mentioned above is as follows:

C:

Since C is an element harmful to the SCC resistance, its content is limited to 0.04% or less.

Si, Mn and Al:

These elements all are deoxidizers, and they are added in a suitable amount in accordance with melting conditions. However, when the contents of Si, Mn and Al exceed upper limits of 1.0%, 1.0% and 0.5%, respectively, the formed alloy will be deteriorated in cleanness. Further, when being less than 0.1%, Al is not effective.

Ni:

This element is effective to improve a corrosion resistance, particularly it serves to improve an acid resistance and the SCC resistance in a high-temperature water including $Cl^-$ ions. For the achievement of these effects, the content of Ni is required to be 40% or more, and its upper limit is set to 70%, taking addition proportions of alloy elements of Cr, Mo, W, V and the like into consideration.

Cr:

The element Cr is essential for the improvement in the corrosion resistance, but its amount less than 25% is insufficient to enhance the SCC resistance. On the contrary, when it is more than 35%, a hot workability will remarkably deteriorate. Therefore, the content of Cr is limited to the range of 25 to 35% in the present invention.

P:

The element P is present in the alloy as an impurity. If its content is above 0.030%, it will exert a harmful influence upon the acid resistance and the hot workability.

S:

The element S is also on of the impurities. If being present in an amount more than 0.02%, it will be deleterious to the acid resistance and hot workability, as in the case of P.

Ti:

This element Ti is added as a stabilizing agent. That is to say, even if the contents of P and S are controlled below the above-mentioned levels, a remarkable effect cannot be obtained. Therefore, in the present invention, Ti is added in an amount of 0.05% or more to assure the desired hot workability. On the contrary, when content of Ti is more than 1.0%, its effect will reach a ceiling level. Therefore, the upper limit of this element is to be set to 1.0%.

Mo, W and V:

These elements are effective to heighten the pitting corrosion resistance especially in a high-temperature water including $Cl^-$ ions.. When the content of at least one of these elements is less than 0.5% in all, the passive coating on the surface will not be heightened and a pitting corrosion will occur, thereby deteriorating the stress corrosion cracking resistance. On the contrary, when the content of at least one of them is more than 5.0% in all, the effect of the improvement in the pitting corrosion resistance will reach a ceiling level, and the hot workability will noticeably be deteriorated. Therefore, in the present invention, the amount of one or more of Mo, W and V to be added is limited to the range of 0.5 to 5.0% in all.

Nb:

In the nickel based alloy (which includes 40% or more of Ni), Nb is greater in the effect of a carbon fixation than Ti. In the present invention, the content of Nb is set to the range of 0.2 to 5.0%. In this range, the ratio of Nb/C will become 10 to 125. In the case of its amount being 0.2% or less, the effect of fixing carbon is small and a sensitization will thus occur, thereby generating the SCC (stress corrosion cracking). On the contrary, when the content of Nb is more than 5%, the effect (carbon fixation) will reach a ceiling level, and additionally the hot workability will noticeably be deteriorated. Therefore, its upper limit is set to 5.0%.

I. Now, reference will be made to the annealing treatment under annealing conditions in th above-mentioned range (Y).

Referring first to FIG. 1, lines BC and CD represent recrystallization lines of the alloy according to the present invention. If the annealing treatment is carried out at a temperature below the levels of the lines BC and CD, no recrystallization will occur, so that the strength of the annealed alloy will be high and its corrosion resistance will be bad. Therefore, the annealing treatment is required to be carried out at a temperature above the levels of the lines BC and CD in accordance with a C content in the alloy. On the other hand, a line AE in the same drawing means an upper limit of temperatures at which the carbon in the alloy is not thoroughly solubilized. Accordingly, so long as the annealing treatment is carried out at a temperature below this upper limit, a carbide will be present in the grains. However, if the annealing operation is done at a temperature above a level of the line AE, all the carbide will be deposited on crystal boundaries in the case that a sensitization treatment is accomplished at a temperature of 600° C. for a period of 3 hours. This will lead to the deterioration in the crystal boundary etching resistance. Therefore, the final annealing is required to be carried out at a temperature below the level of the line AE.

Now, the present invention will further be described in detail in accordance with examples below.

EXAMPLES 1 to 29

Alloys (Alloy of the present invention 1 to 29, conventional alloys Nos. 30 to 37 and comparative alloys Nos. 38 to 41) of compositions comprising chemical components exhibited in Table 1 below were dissolvingly formed in a 17-kg vacuum furnace and subjected to a forging, hot rolling and thermal treatment under usual conditions, and they were then cold rolled as much as 30%, followed by annealing at a variety of temperatures. Further, a thermal treatment, i.e. a sensitization treatment on conditions, 600° C.×3 hours, which were set on the basis of a supposed life in practical use was carried out, and 3-mm-thick×10-mm-wide×40-mm-long speciments for crystal boundary etching tests and 2-mm-thick×10-mm-wide×75-mm-long specimens for stress corrosion cracking tests were then prepared. These speciments were polished by the use of emery paper No. 320 and were then employed for the tests below.

First, the specimens for the stress corrosion cracking tests were, after polished, caused to overlap each other every 2 specimens and each pair of them was bent into a U-shape to prepare double U-bent speciments. The thus prepared specimens were immersed in a solution including 1000 pp of $Cl^-$ (as NaCl) at 325° C. for 1500 hours by the use of an autoclave (a high-temperature high-pressure container). After the completion of the tests, cracks on inside surfaces of the specimens were measured for their depth by a microscope.

On the other hand, the specimens for the crystal boundary etching tests were immersed in a boiling solution including 60% of $HNO_3$ and 0.1% of HF for 4 hours, and a weight loss caused by the corrosion was measured.

Obtained test results are shown by graphs in FIGS. 2 to 5. Reference numerals in the graphs represent the numbers of the specimen alloys in Table 1.

Figure 2:
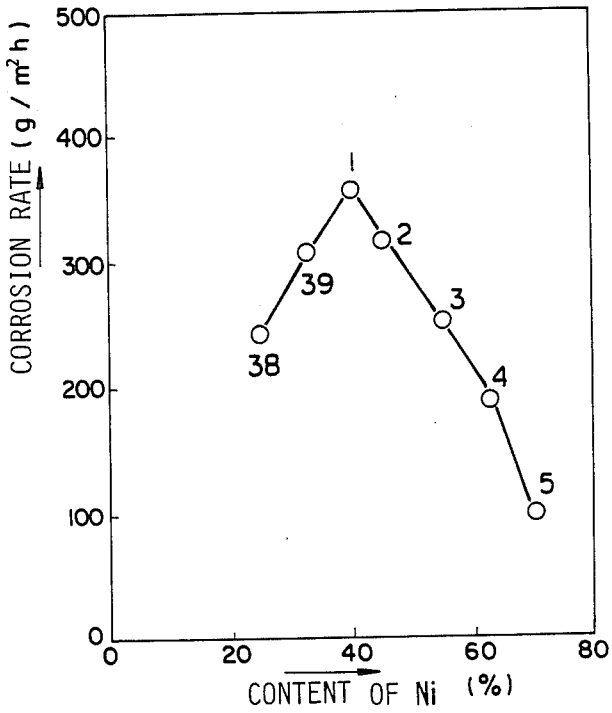

A variety of amounts of Ni was added to each fundamental composition comprising 0.02 to 0.03% of C., 25% of Cr and 0.6% of Mo according to the present invention to prepare alloy specimens, and an annealing treatment was then carried out by heating the specimens at 1150° C. for 30 minutes. After water cooling, a sensitization treatment was carried out by heating them at 600° C. for 3 hours and they were then cooled. The aforesaid crystal boundary etching tests were accomplished on the specimens to prepare data. FIG. 2 exhibits the thus obtained data. The aforesaid annealing temperature was higher than that of the present invention.

Even in the case of the alloy having the same composition as the alloy according to the present invention, if the annealing temperature is high and when 3 hours' heating at 600° C. (the sensitization treatment) and an air cooling operation are carried out, the carbide of Cr will all deposit on the crystal boundaries and Cr-free layers will be formed in the vicinity of the crystal boundaries, so that corrosion will occur. Therefore, it is necessary to lower the annealing temperature.

Figure 3:
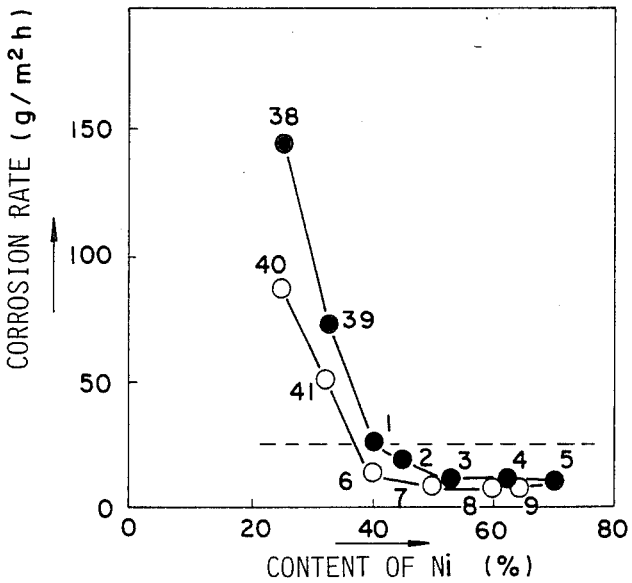
Figure 4:
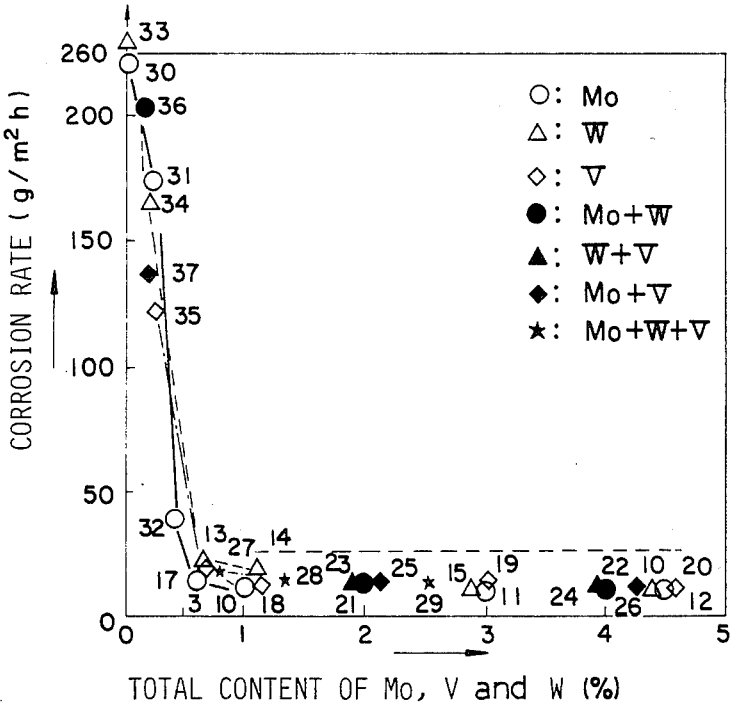

The graphs in FIG. 3 show the crystal boundary etching resistances of the alloys comprising the compositions regarding the present invention and conventional alloys. The alloys in both the groups which had the composition of 0.02 to 0.03% of C and 0.6% of Mo were heated at 900° C. for 30 minutes to accomplish the annealing treatment. After water cooling, they were heated at 600° C. for 3 hours to accomplish the sensitization treatment, followed by air cooling. In FIG. 3, white and black circles represent the alloys including more than 30% of Cr and those including 25 to 30% of Cr, respectively. As understood from the graphs in this drawing, the alloys including an Ni amount below 40% are all great in a corrosion rate; the alloys including an Ni amount of 40% or more have an improved crystal boundary etching resistance. Therefore, the Ni content of 40% or more is necessary.

One or more of Mo, V and W were added to each fundamental composition comprising 0.02% of C, 25% of Cr and 50% of Ni in order to prepare alloy specimens, and an anneling treatment was then carried out by heating the prepared specimens at 900° C. for 30 minutes. After water cooling, the sensitization treatment was carried out by heating them at 600° C. for 3 hours and they was then air cooled. Thus obtained results of the crystal boundary etching tests are exhibited in FIG. 4. This drawing indicates that when the total amount of at least one of Mo, V and W is less than 0.5%, any improvement in corrosion resistance is not seen, but when its content is 0.5% or more, the crystal boundary etching resistance is built up. This would be considered to allow a $Cr_2O_3$ coating formed on the alloy surface to stably exist, because the added Mo, V and W strengthen the passive coating. Hence, the total amount of one or more of the added Mo, V and W is required to be 0.5% or more.

Figure 5:
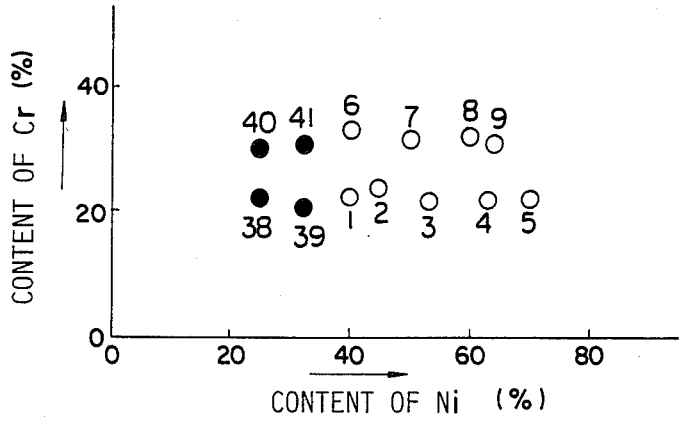

The graphs in FIG. 5 show influences of an Ni content (%) and Cr content (%) upon the SCC resistance. Used alloy specimens were prepared through the annealing treatment of 30 minutes' heating at 900° C., water cooling, sensitization treatment of 3 hours' heating at 600° C., and air cooling. In this drawing, white and black circles represent the alloys without stress corrosion cracks and those with some cracks of 20μ or more.

It is apparent that even if the Cr content is 20% or more as in the present invention, when the Ni content is less than 40%, crystal boundary type stress corrosion cracks will occur. Therefore, the Ni content is required to be 40% or more.

TABLE 1

| Alloy No. | (% by weight) C | Si | Mn | P | S | Ni | Cr | Ti | Mo | W | V | Fe |
|---|---|---|---|---|---|---|---|---|---|---|---|---|
| Alloys of the Present Invention | | | | | | | | | | | | |
| 1 | 0.017 | 0.41 | 0.41 | 0.011 | 0.008 | 40.05 | 25.37 | 0.18 | 0.65 | | | Residue |
| 2 | 0.019 | 0.42 | 0.43 | 0.010 | 0.005 | 45.00 | 27.50 | 0.25 | 0.63 | — | — | " |
| 3 | 0.018 | 0.41 | 0.41 | 0.011 | 0.006 | 53.50 | 26.50 | 0.27 | 0.64 | — | — | " |
| 4 | 0.016 | 0.40 | 0.42 | 0.012 | 0.007 | 70.67 | 25.75 | 0.26 | 0.66 | — | — | " |
| 5 | 0.018 | 0.40 | 0.43 | 0.009 | 0.006 | 25.20 | 31.37 | 0.35 | 0.62 | — | — | " |
| 6 | 0.019 | 0.51 | 0.42 | 0.018 | 0.011 | 40.08 | 31.30 | 0.23 | 0.58 | — | — | " |
| 7 | 0.017 | 0.42 | 0.41 | 0.018 | 0.013 | 49.80 | 33.45 | 0.24 | 0.65 | — | — | " |
| 8 | 0.021 | 0.49 | 0.48 | 0.017 | 0.010 | 60.05 | 31.45 | 0.23 | 0.67 | — | — | " |
| 9 | 0.020 | 0.48 | 0.48 | 0.015 | 0.010 | 64.35 | 33.25 | 0.23 | 0.63 | — | — | " |
| 10 | 0.025 | 0.48 | 0.47 | 0.013 | 0.011 | 50.35 | 25.47 | 0.27 | 1.00 | — | — | " |
| 11 | 0.026 | 0.49 | 0.48 | 0.014 | 0.010 | 50.45 | 25.75 | 0.37 | 3.05 | — | — | " |
| 12 | 0.009 | 0.41 | 0.43 | 0.012 | 0.009 | 50.35 | 26.45 | 0.27 | 4.50 | — | — | " |
| 13 | 0.021 | 0.43 | 0.43 | 0.012 | 0.008 | 50.25 | 26.25 | 0.20 | — | 0.63 | — | " |
| 14 | 0.025 | 0.42 | 0.42 | 0.013 | 0.009 | 51.25 | 25.35 | 0.21 | — | 1.10 | — | " |
| 15 | 0.027 | 0.44 | 0.43 | 0.012 | 0.008 | 50.37 | 25.36 | 0.19 | — | 2.90 | — | " |
| 16 | 0.032 | 0.49 | 0.44 | 0.009 | 0.009 | 51.37 | 26.26 | 0.25 | — | 4.40 | — | " |
| 17 | 0.021 | 0.43 | 0.42 | 0.012 | 0.012 | 50.45 | 25.58 | 0.27 | — | — | 0.65 | " |
| 18 | 0.023 | 0.42 | 0.41 | 0.011 | 0.008 | 50.46 | 26.45 | 0.36 | — | — | 1.15 | " |
| 19 | 0.028 | 0.41 | 0.42 | 0.012 | 0.012 | 51.36 | 25.36 | 0.35 | — | — | 3.05 | " |
| 20 | 0.029 | 0.43 | 0.44 | 0.011 | 0.009 | 51.38 | 25.47 | 0.34 | — | — | 4.60 | " |
| 21 | 0.019 | 0.42 | 0.43 | 0.013 | 0.008 | 51.46 | 26.80 | 0.45 | 1.2 | 0.8 | — | " |
| 22 | 0.023 | 0.43 | 0.44 | 0.015 | 0.009 | 52.16 | 25.60 | 0.37 | 2.3 | 1.7 | — | " |
| 23 | 0.025 | 0.44 | 0.46 | 0.012 | 0.010 | 51.65 | 26.37 | 0.25 | 1.6 | 0.4 | — | " |
| 24 | 0.009 | 0.43 | 0.45 | 0.011 | 0.009 | 51.75 | 27.46 | 0.16 | 2.85 | 1.1 | — | " |
| 25 | 0.016 | 0.48 | 0.36 | 0.012 | 0.008 | 50.36 | 26.36 | 0.47 | 1.0 | — | 1.15 | " |
| 26 | 0.037 | 0.47 | 0.35 | 0.011 | 0.003 | 51.39 | 26.07 | 0.36 | 2.25 | — | 2.0 | " |

TABLE 1-continued

| Alloy No. | (% by weight) C | Si | Mn | P | S | Ni | Cr | Ti | Mo | W | V | Fe |
|---|---|---|---|---|---|---|---|---|---|---|---|---|
| 27 | 0.026 | 0.46 | 0.36 | 0.009 | 0.006 | 51.46 | 26.34 | 0.46 | 0.4 | 0.2 | 0.20 | " |
| 28 | 0.025 | 0.47 | 0.37 | 0.010 | 0.008 | 50.36 | 25.98 | 0.26 | 0.8 | 0.2 | 0.35 | " |
| 29 | 0.018 | 0.49 | 0.43 | 0.011 | 0.007 | 51.05 | 25.46 | 0.36 | 0.8 | 0.8 | 0.95 | " |
| 30 | 0.030 | 0.49 | 0.43 | 0.016 | 0.011 | 50.46 | 25.35 | 0.26 | — | — | — | " |
| 31 | 0.030 | 0.43 | 0.44 | 0.012 | 0.013 | 50.48 | 25.45 | 0.25 | 0.25 | — | — | " |
| 32 | 0.026 | 0.46 | 0.44 | 0.011 | 0.009 | 50.36 | 25.95 | 0.27 | 0.4 | — | — | " |
| 33 | 0.038 | 0.43 | 0.43 | 0.018 | 0.010 | 50.37 | 25.86 | 0.25 | — | — | — | " |
| 34 | 0.025 | 0.46 | 0.47 | 0.025 | 0.012 | 51.36 | 25.74 | 0.24 | — | 0.2 | — | " |
| 35 | 0.024 | 0.47 | 0.47 | 0.020 | 0.011 | 50.41 | 25.36 | 0.26 | — | — | 0.25 | " |
| 36 | 0.023 | 0.48 | 0.48 | 0.018 | 0.009 | 50.36 | 25.47 | 0.26 | 0.10 | 0.05 | — | " |
| 37 | 0.020 | 0.48 | 0.47 | 0.020 | 0.010 | 50.41 | 25.36 | 0.25 | 0.05 | 0.05 | 0.10 | " |
| Alloys for Comparison | | | | | | | | | | | | |
| 38 | 0.023 | 0.51 | 0.37 | 0.014 | 0.009 | 25.30* | 25.10 | 0.15 | 0.60 | — | — | " |
| 39 | 0.028 | 0.50 | 0.41 | 0.013 | 0.009 | 33.2* | 25.00 | 0.16 | 0.70 | — | — | " |
| 40 | 0.024 | 0.36 | 0.48 | 0.012 | 0.008 | 25.15* | 31.50 | 0.36 | 0.65 | — | — | " |
| 41 | 0.020 | 0.42 | 0.36 | 0.016 | 0.009 | 32.45* | 32.56 | 0.25 | 0.67 | — | — | " |

Note:
*Outside the present invention. The conventional alloys all did not include Mo, W and V in amounts required in the present invention.

II. Next, the following will be made to the annealing treatment at a temperature of 900° to 975° C.

In the present invention, the annealing treatment is carried out at a temperature of 900° to 975° C. However, when this annealing temperature is less than 900° C., recrystallization cannot be effected. Therefore, the treated alloy has a high strength and is insufficient in the corrosion resistance. On the contrary, when the annealing temperature is more than 975° C., the carbon in the alloy will be thoroughly solubilized during the nnealing operation, so that no carbide will exist in the grains any more. Therefore, when a temperature above 975° C. is employed for the annealing operation and when the conditions of 600° C.×5 hours are taken for the sensitization treatment, the carbide will all deposit on crystal boundaries and the crystal boundary etching resistance will thus be deteriorated. Accordingly, the final annealing operation in the present invention is carried out at a temperature of 900° to 975° C.

EXAMPLE 30 to 65

Alloys (Alloy Nos. of the present invention 1 to 36 and comparative alloys Nos. 37 to 63) of compositions comprising chemical components exhibited in Table 2 below were dissolvingly formed in a 17-kg vacuum furnace and subjected to a forging, hot rolling and thermal treatment under usual conditions, and they were then cold rolled as much as 30%, followed by annealing at a variety of temperatures. Further, a thermal treatment, i.e. a sensitization treatment on conditions, 600° C.×5 hours, which were set on the basis of a supposed life in practical use was carried out, and 3-mm-thick×10-mm-wide×40-mm-long specimens for crystal boundary etching tests and 2-mm-thick×10-mm-wide×75-mm-long specimens for stress corrosion cracking tests were then prepared. These specimens were polished by the use of emery paper No. 320 and were then employed in tests below.

First, the specimens for the stress corrosion cracking tests were, after plished, caused to overlap each other every 2 specimens and were bent into a U-shape to parepare double U-bent specimens. The thus prepared specimens were immersed in a solution including 1000 ppm of $Cl^-$ (as NaCl) at 330° C. for 1500 hours by the use of an autoclave (a high-temperature and high-pressure container). After the completion of the tests, cracks on inside surfaces of the specimens were measured for their depth by a microscope.

On the other hand, the specimens for the crystal boundary etching tests were immersed in a boiling solution including 60% of $HNO_3$ and 0.1% of HF for 4 hours, and a weight loss caused by the corrosion wa measured.

Figure 6:
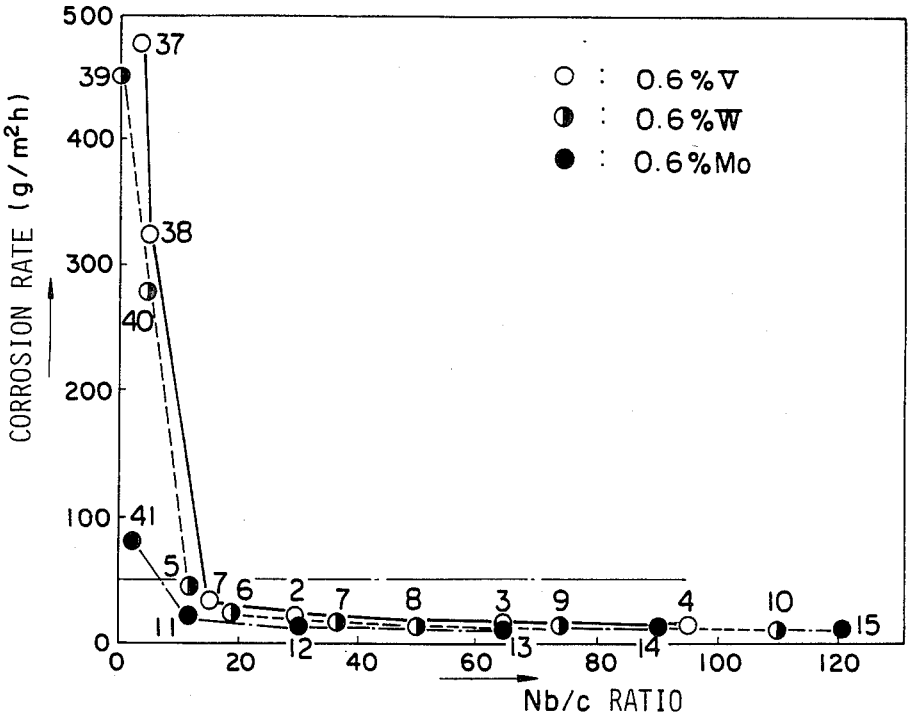
FIGS. 6 to 10 illustrate the case where 0.2 to 5.0% of Nb is additionally added subject to Ti=0.2 to 1.0% and Nb/C=10 to 125 and an annealing temperature is 900° to 975° C., and they are graphs showing test results of Examples according to the present invention.

Graphs in FIG. 6 show crystal boundary etching test results of the alloys in which about 0.6% of Mo, W and V was respectively added to the 25% Cr-55% Ni system alloy and various amounts of Nb were added thereto varying the ratio of Nb/C. In each case, an annealing treatment was carried out by heating the alloy specimen at 950° C. for 30 minutes. After water cooling, the sensitization treatment was carried out by heating them at 600° C. for 5 hours and they were then air cooled. FIG. 6 indicates that the alloys in which the ratio of Nb/C is less than 10 is very bad in the crystal boundary etching resistance, but when this ratio is 10 or more, the crystal boundary etching resistance is sharply improved. This phenomenon would be pressumed as follows: If Nb is not added to the alloy in a plenty amount, the sensitization treatment will bring about the deposition of Cr carbide on crystal boundaries, and Cr-free layers will thus be formed in the vicinity of the crystal boundaries, which will lead to the deterioration in the corrosion resistance. In order to accomplish the fixation of carbon, therefore, an enough amount of Nb, i.e. the great ratio of Nb/C is necessary, and a value of this ratio is required to be 10 or more.

Figure 7:
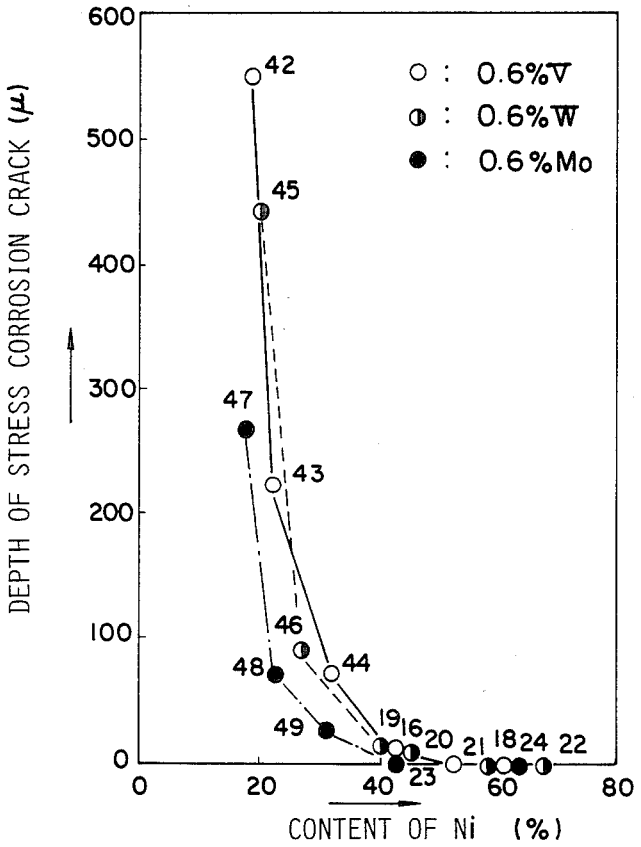

FIG. 7 shows SCC test results of the alloys in which the Nb/C was 12 to 20; a Cr content was 25%1 Mo, W and V were respectively included in an amount of 0.6%; and an Ni content was caused to vary within the range of 18 to 75%. The used alloy specimens were prepared by heating them at 950° C. for 30 minutes to accomplish the annealing treatment, followed by water cooling.

The drawing above indicates that if the Ni content is less than 40%, even the 25% Cr alloy in which the Nb/C is 10 or more and Mo, V and W are each contained in an amount of 0.6% will bring bout some stress corrosion cracks. Therefore, it is definite that when the Ni content is 40% or more, a responsiveness to the SCC will be high.

Figure 8:
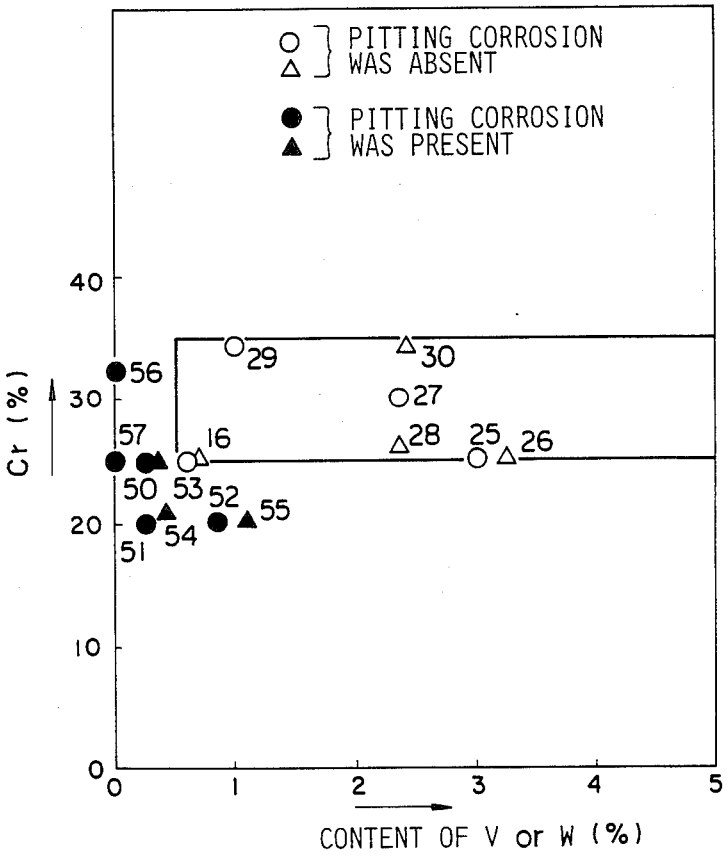

Graphs in FIG. 8 indicate the presence of a pitting corrosion on the Cr-V-W alloys in a high-temperature and high-pressure solution including 1000 ppm of $Cl^-$ ions, in which alloy the Nb/C was 12 or more and the Ni content was 40% or more. The alloy specimens were used which were prepared by heating them at 950° C. for 30 minutes in order to accomplish the annealing treatment, followed by water cooling. In FIG. 8, circle and triangle marks represent the alloy specimens including V and the specimens including W, respectively. As seen from the drawing, if the Cr content is less than 25%, the pitting corrosion will occur, even though the contents of V and W each are 0.6% or more and the ratio of the Nb/C is 12 or more. Further, if the contents of V and W each are less than 0.5%, the pitting corrosion will occur even if the Cr content is more than 25%. Therefore, it is necessary for the inhibition of the pitting corrosion that the Cr content is 25% or more and the V or W content is 0.5%, preferably 0.6%. It can be considered from the foregoing that the passive coating only including 25% of Cr is insufficient to prevent the occurrence of the pitting corrosion and the addition of at least one of V and W in the total amount of 0.5% or more permits strengthening the passive coating and withstanding an attack of $Cl^-$ ions. Thus, it is apparent that the pitting corrosion resistance can be improved by the synergistic effect resulting from the addition of Cr, V and/or W.

Figure 9:
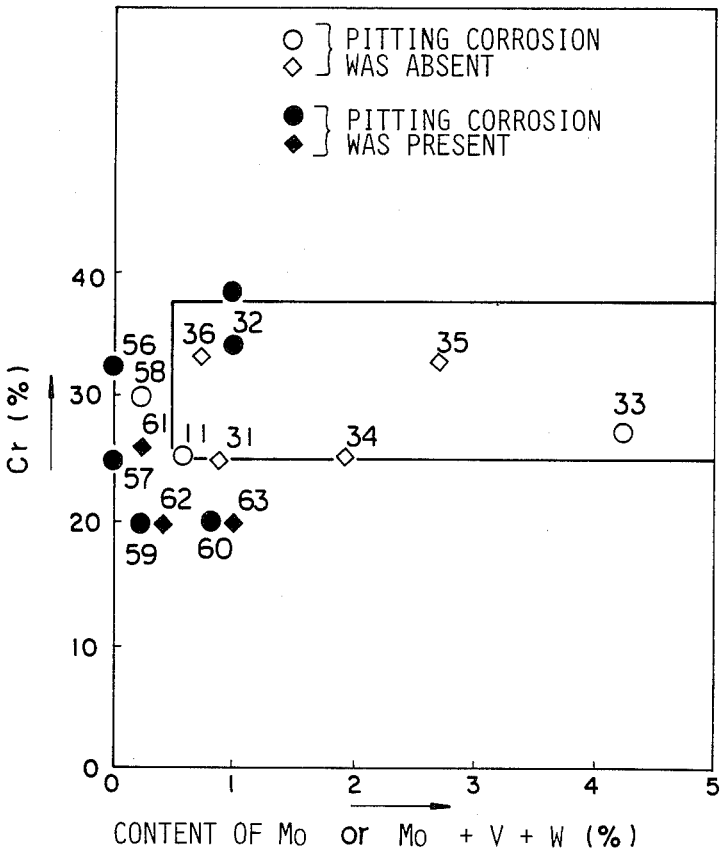

FIG. 9 shows, as in FIG. 8, data regarding the pitting corrosion resistance of the alloys each in which Mo or a group of Mo, W and V is further included in addition to such a synergistic effect. The alloy specimens were used which were prepared by heating them at 950° C. for 30 minutes in order to accomplish the annealing treatment, followed by water cooling. In FIG. 9, circle and rhomb marks represent the alloy specimens including Mo and the group of Mo, W and V, respectively.

It can be understood from the graphs in this drawing that the improvement in the pitting corrosion resistance is accomplished under the requirements that the content of Cr is 25% or more and the content of Mo or the group of Mo, V and W is 0.5% or more, preferably 0.6% or more.

Figure 10:
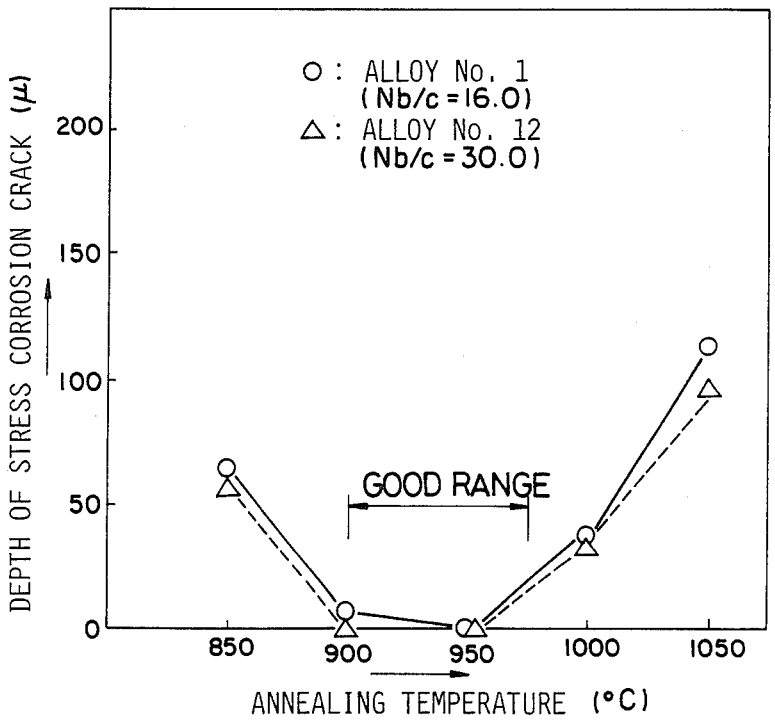

The graphs in FIG. 10 show influence of the annealing temperatures upon the stress corrosion cracking. In this case the specimens of alloy Nos. 1 and 12 exhibited in Table 2 were employed, and the annealing operation was carried out variously changing the annealing temperatures within the range of 850° to 1050° C. Then, the sensitization treatment was carried out by heating them at 600° C. for 5 hours and they were then air cooled. Stress corrosion cracking tests were effected on the thus obtained specimens to measure a depth of cracks. As be definite from the illustrated data, the alloy specimens which were annealed at a temperature of 900° to 975° C. are excellent in the stress corrosion cracking resistance. This reason would be that NbC deposits in order to fix the solubilized carbon.

TABLE 2

| Alloy No. | (% by weight) | | | | | | | | | | | | |
|---|---|---|---|---|---|---|---|---|---|---|---|---|---|
| | C | Si | Mn | P | S | Ni | Cr | Ti | Nb | V | W | Mo | Fe |
| 1 | 0.025 | 0.41 | 0.36 | 0.009 | 0.003 | 55.21 | 25.45 | 0.25 | 0.40 | 0.61 | — | — | Residue |
| 2 | 0.013 | 0.47 | 0.37 | 0.012 | 0.009 | 55.01 | 25.36 | 0.21 | 0.40 | 0.62 | — | — | " |
| 3 | 0.012 | 0.45 | 0.36 | 0.011 | 0.011 | 55.31 | 25.46 | 0.36 | 0.80 | 0.60 | — | — | " |
| 4 | 0.011 | 0.44 | 0.38 | 0.014 | 0.010 | 55.21 | 25.36 | 0.25 | 1.05 | 0.65 | — | — | " |
| 5 | 0.020 | 0.43 | 0.37 | 0.012 | 0.010 | 55.46 | 25.45 | 0.21 | 0.24 | — | 0.63 | — | " |
| 6 | 0.015 | 0.47 | 0.42 | 0.016 | 0.009 | 55.12 | 25.46 | 0.24 | 0.30 | — | 0.61 | — | " |
| 7 | 0.018 | 0.47 | 0.42 | 0.012 | 0.010 | 55.18 | 25.86 | 0.27 | 0.67 | — | 0.68 | — | " |
| 8 | 0.026 | 0.46 | 0.41 | 0.011 | 0.009 | 55.36 | 25.76 | 0.26 | 1.30 | — | 0.68 | — | " |
| 9 | 0.034 | 0.50 | 0.41 | 0.012 | 0.008 | 55.46 | 25.43 | 0.27 | 2.51 | — | 0.63 | — | " |
| 10 | 0.030 | 0.51 | 0.40 | 0.009 | 0.005 | 55.76 | 25.37 | 0.27 | 3.30 | — | 0.66 | — | " |
| 11 | 0.025 | 0.50 | 0.41 | 0.009 | 0.006 | 55.86 | 25.48 | 0.26 | 0.30 | — | — | 0.60 | " |
| 12 | 0.021 | 0.46 | 0.46 | 0.009 | 0.006 | 55.86 | 25.48 | 0.26 | 0.30 | — | — | 0.61 | " |
| 13 | 0.031 | 0.46 | 0.42 | 0.009 | 0.008 | 55.47 | 25.37 | 0.27 | 1.98 | — | — | 0.65 | " |
| Alloys of the Present Invention | | | | | | | | | | | | | |
| 14 | 0.030 | 0.47 | 0.41 | 0.009 | 0.006 | 55.67 | 25.47 | 0.31 | 2.70 | — | — | 0.62 | " |
| 15 | 0.036 | 0.43 | 0.42 | 0.010 | 0.007 | 55.86 | 25.36 | 0.21 | 4.32 | — | — | 0.69 | " |
| 16 | 0.021 | 0.42 | 0.41 | 0.011 | 0.008 | 42.01 | 25.36 | 0.19* | 0.42 | 0.62 | — | — | " |
| 17 | 0.020 | 0.43 | 0.42 | 0.009 | 0.006 | 52.00 | 25.36 | 0.18* | 0.40 | 0.63 | — | — | " |
| 18 | 0.022 | 0.48 | 0.43 | 0.010 | 0.006 | 60.85 | 25.46 | 0.21 | 0.44 | 0.63 | — | — | " |
| 19 | 0.021 | 0.46 | 0.46 | 0.009 | 0.006 | 40.37 | 25.36 | 0.22 | 0.42 | — | 0.64 | — | " |
| 20 | 0.036 | 0.47 | 0.42 | 0.010 | 0.007 | 45.00 | 25.37 | 0.21 | 0.72 | — | 0.66 | — | " |
| 21 | 0.026 | 0.51 | 0.52 | 0.010 | 0.007 | 58.20 | 25.37 | 0.20 | 0.52 | — | 0.63 | — | " |
| 22 | 0.026 | 0.50 | 0.51 | 0.009 | 0.008 | 67.20 | 25.47 | 0.21 | 0.52 | — | 0.66 | — | " |
| 23 | 0.020 | 0.50 | 0.52 | 0.009 | 0.006 | 42.56 | 25.06 | 0.19* | 0.40 | — | — | 0.68 | " |
| 24 | 0.019 | 0.51 | 0.50 | 0.011 | 0.007 | 62.50 | 25.37 | 0.18* | 0.38 | — | — | 0.69 | " |
| 25 | 0.018 | 0.49 | 0.46 | 0.012 | 0.006 | 58.36 | 25.34 | 0.12* | 0.36 | 3.01 | — | — | " |
| 26 | 0.019 | 0.48 | 0.47 | 0.011 | 0.007 | 59.47 | 25.75 | 0.13* | 0.38 | — | 3.25 | — | " |
| 27 | 0.022 | 0.43 | 0.46 | 0.009 | 0.006 | 62.36 | 31.25 | 0.26 | 0.44 | 2.35 | — | — | " |
| 28 | 0.028 | 0.46 | 0.47 | 0.009 | 0.006 | 57.85 | 26.36 | 0.24 | 0.56 | — | 2.35 | — | " |
| 29 | 0.027 | 0.47 | 0.48 | 0.008 | 0.005 | 53.45 | 34.60 | 0.21 | 0.54 | 1.00 | — | — | " |
| 30 | 0.031 | 0.50 | 0.49 | 0.009 | 0.006 | 53.21 | 33.85 | 0.23 | 0.62 | — | 2.40 | — | " |
| 31 | 0.032 | 0.51 | 0.51 | 0.010 | 0.007 | 54.36 | 25.18 | 0.18* | 0.64 | 0.20 | 0.30 | 0.40 | " |
| 32 | 0.027 | 0.52 | 0.52 | 0.009 | 0.008 | 62.46 | 34.26 | 0.23 | 0.81 | — | — | 1.02 | " |
| 33 | 0.012 | 0.53 | 0.51 | 0.008 | 0.009 | 49.36 | 27.21 | 0.28 | 0.45 | — | — | 4.25 | " |
| 34 | 0.013 | 0.48 | 0.49 | 0.009 | 0.008 | 52.36 | 25.36 | 0.18* | 0.42 | 0.3 | 0.4 | 1.25 | " |
| 35 | 0.015 | 0.47 | 0.47 | 0.012 | 0.008 | 51.38 | 32.36 | 0.25 | 0.46 | 1.36 | 0.52 | 0.85 | " |
| 36 | 0.025 | 0.47 | 0.47 | 0.012 | 0.007 | 55.49 | 33.29 | 0.25 | 0.56 | 0.21 | 0.11 | 0.42 | " |
| Alloys for Comparison | | | | | | | | | | | | | |
| 37 | 0.026 | 0.51 | 0.48 | 0.016 | 0.006 | 55.27 | 25.36 | 0.19* | 0.078* | 0.61 | — | — | " |
| 38 | 0.038 | 0.52 | 0.47 | 0.009 | 0.005 | 55.16 | 25.46 | 0.16* | 0.19* | 0.62 | — | — | " |
| 39 | 0.029 | 0.51 | 0.46 | 0.009 | 0.006 | 55.27 | 25.36 | 0.11* | — | — | 0.63 | — | " |
| 40 | 0.022 | 0.50 | 0.51 | 0.012 | 0.008 | 55.37 | 25.46 | 0.12* | 0.11* | — | 0.64 | | " |

TABLE 2-continued

| Alloy No. | (% by weight) C | Si | Mn | P | S | Ni | Cr | Ti | Nb | V | W | Mo | Fe |
|---|---|---|---|---|---|---|---|---|---|---|---|---|---|
| 41 | 0.023 | 0.52 | 0.49 | 0.012 | 0.007 | 55.42 | 25.36 | 0.12* | 0.069* | — | — | 0.62 | " |
| 42 | 0.021 | 0.47 | 0.48 | 0.016 | 0.009 | 18.50* | 25.36 | 0.09* | 0.30* | 0.61 | — | — | " |
| 43 | 0.025 | 0.46 | 0.48 | 0.016 | 0.010 | 22.51* | 25.36 | 0.05* | 0.30 | 0.63 | — | — | " |
| 44 | 0.037 | 0.48 | 0.49 | 0.014 | 0.009 | 32.50* | 25.36 | 0.06* | 0.44 | 0.62 | — | — | " |
| 45 | 0.029 | 0.49 | 0.51 | 0.016 | 0.010 | 20.02* | 25.36 | 0.07* | 0.35 | — | 0.62 | — | " |
| 46 | 0.035 | 0.37 | 0.46 | 0.012 | 0.010 | 26.75* | 25.47 | 0.06* | 0.42 | — | 0.61 | — | " |
| 47 | 0.034 | 0.38 | 0.46 | 0.014 | 0.010 | 18.02* | 25.36 | 0.07* | 0.41 | — | — | 0.62 | " |
| 48 | 0.035 | 0.37 | 0.46 | 0.014 | 0.009 | 22.86* | 25.10 | 0.07* | 0.39 | — | — | 0.61 | " |
| 49 | 0.037 | 0.41 | 0.41 | 0.016 | 0.010 | 31.67* | 25.27 | 0.07* | 0.41 | — | — | 0.63 | " |
| 50 | 0.032 | 0.42 | 0.43 | 0.012 | 0.009 | 42.74 | 25.37 | 0.09 | 0.42 | 0.25* | — | — | " |
| 51 | 0.026 | 0.43 | 0.44 | 0.011 | 0.010 | 43.16 | 20.02* | 0.08* | 0.34 | 0.25* | — | — | " |
| 52 | 0.029 | 0.47 | 0.46 | 0.009 | 0.012 | 43.26 | 20.12* | 0.09* | 0.34 | 0.85 | — | — | " |
| 53 | 0.028 | 0.46 | 0.47 | 0.009 | 0.011 | 43.26 | 25.17 | 0.09* | 0.34 | — | 0.35* | — | " |
| 54 | 0.036 | 0.46 | 0.45 | 0.013 | 0.012 | 41.28 | 20.85* | 0.09* | 0.43 | — | 0.41* | — | " |
| 55 | 0.029 | 0.46 | 0.45 | 0.016 | 0.013 | 42.36 | 20.23* | 0.10* | 0.35 | — | 1.10 | — | " |
| 56 | 0.031 | 0.39 | 0.38 | 0.013 | 0.010 | 42.85 | 32.50 | 0.09* | 0.37 | — | — | — | " |
| 57 | 0.028 | 0.40 | 0.41 | 0.015 | 0.009 | 45.26 | 25.06 | 0.09* | 0.34 | — | — | — | " |
| 58 | 0.036 | 0.40 | 0.40 | 0.014 | 0.008 | 41.27 | 30.01 | 0.08* | 0.40 | — | — | 0.25* | " |
| 59 | 0.027 | 0.41 | 0.39 | 0.012 | 0.009 | 40.36 | 20.02* | 0.07* | 0.30 | — | — | 0.25* | " |
| 60 | 0.031 | 0.42 | 0.39 | 0.012 | 0.009 | 41.36 | 20.16* | 0.10* | 0.34 | — | — | 0.80 | " |
| 61 | 0.032 | 0.42 | 0.41 | 0.014 | 0.007 | 41.27 | 25.98 | 0.11* | 0.35 | 0.06* | 0.11* | 0.08* | " |
| 62 | 0.036 | 0.40 | 0.40 | 0.016 | 0.008 | 41.37 | 20.09* | 0.10* | 0.40 | 0.08* | 0.16* | 0.18* | " |
| 63 | 0.037 | 0.39 | 0.41 | 0.015 | 0.009 | 41.67 | 20.36* | 0.12* | 0.41 | 0.45* | 0.21 | 0.36 | " |

Note:
*Outside the present invention.

What is claimed is:

1. A nickel-chromium alloy heat treated product excellet in a stress corrosion cracking resistance which is obtained by carrying out an annealing treatment under conditions defined by points A,B,C,D and E of FIG. 1, said alloy consisting essentially of the following composition:

| in terms of % by weight, | |
|---|---|
| not more than 0.04% C; | not more than 1.0% Si; |
| not more than 1.0% Mn; | not more than 0.030% P; |
| not more tham 0.02% S; | 40 to 70% Ni; |
| 25 to 35% Cr; | 0.1 to 0.5% Al; |
| 0.05 to 1.0% of Ti; | |

0.5 to 5.0% of a metal selected from the group consisting of Mo, W, V and mixtures thereof; and balance Fe.

2. A nickel-chromium alloy heat treated product excellent in stress corrosion cracking resistance which is obtained by carrying out an annealing treatment at a temperature of from 900° C. to 975° C. and consisting essentially of the following elements in terms of % by weight:

| | |
|---|---|
| not more than 0.04% C; | not more than 1.0% Si; |
| not more than 1.0% Mn; | not more than 0.030% P; |
| not more than 0.02% S; | 40 to 70% Ni |
| 25 to 35% Cr; | 0.1 to 0.5% al; |
| 0.2 to 1.0% Ti; | 0.2 to 5.0% Nb; |

0.5 to 5% of a metal selected from the group consisting of Mo, W, V and mixtures thereof; balance Fe: with the proviso that the Nb/C ratio is 10 to 125.

* * * * *